US009945117B2

(12) United States Patent
Cobb

(10) Patent No.: US 9,945,117 B2
(45) Date of Patent: Apr. 17, 2018

(54) CUSTOMIZABLE CLOSURE SYSTEM

(71) Applicant: Coastal Industries, Inc., Jacksonville, FL (US)

(72) Inventor: Patrick Cobb, Jacksonville, FL (US)

(73) Assignee: Coastal Industries, Inc., Jacksonville, FL (US)

( * ) Notice: Subject to any disclaimer, the term of this patent is extended or adjusted under 35 U.S.C. 154(b) by 0 days.

(21) Appl. No.: 14/707,925

(22) Filed: May 8, 2015

(65) Prior Publication Data

US 2015/0322702 A1 Nov. 12, 2015

Related U.S. Application Data

(60) Provisional application No. 61/990,770, filed on May 9, 2014, provisional application No. 62/067,944, filed on Oct. 23, 2014, provisional application No. 62/116,767, filed on Feb. 16, 2015.

(51) Int. Cl.

| | |
|---|---|
| ***E04B 2/74*** | (2006.01) |
| ***E05D 15/06*** | (2006.01) |
| ***E05D 15/08*** | (2006.01) |
| ***E05D 15/26*** | (2006.01) |
| ***E06B 1/52*** | (2006.01) |
| ***E06B 3/36*** | (2006.01) |
| ***E06B 3/46*** | (2006.01) |
| ***E06B 3/48*** | (2006.01) |
| ***A47K 3/30*** | (2006.01) |
| ***A47K 3/34*** | (2006.01) |
| ***A47K 3/36*** | (2006.01) |

(Continued)

(52) U.S. Cl.

CPC ..... *E04B 2/7427* (2013.01); *A47K 3/30* (2013.01); *A47K 3/34* (2013.01); *A47K 3/36* (2013.01); *E04B 2/7429* (2013.01); *E05D 15/063* (2013.01); *E05D 15/0652* (2013.01); *E05D 15/08* (2013.01); *E05D 15/26* (2013.01); *E06B 1/52* (2013.01); *E06B 3/36* (2013.01); *E06B 3/4636* (2013.01); *E06B 3/481* (2013.01); *E04B 2/828* (2013.01); *E06B 3/72* (2013.01)

(58) Field of Classification Search

CPC ..... E04B 2/7427; E04B 2/7429; E04B 2/31

USPC ..... 49/409; 52/204.6

See application file for complete search history.

(56) References Cited

U.S. PATENT DOCUMENTS 3,566,561 A * 3/1971 Tozer ..... A47B 96/00 52/127

4,147,198 A * 4/1979 Ytter ..... E04B 2/7405 160/135

(Continued)

FOREIGN PATENT DOCUMENTS

GB 2286410 A * 8/1995 ..... E04B 2/7427

*Primary Examiner* — Katherine W Mitchell
*Assistant Examiner* — Marcus Menezes
(74) *Attorney, Agent, or Firm* — Andres F. Arrubla

(57) ABSTRACT

A customizable closure system comprising panels of a pre-selected size and one or more conversion kits for mounting the panels. A room divider conversion kit comprises a hinge for converting the panels into room dividers, and a bypass conversion kit comprises a header for converting the panels into slidable panel doors, such as a closure for a shower area. Other conversion kits include a swing conversion kit and a hanger conversion kit. One embodiment of the panels further comprises a reinforcing system for securely retaining the panes with the panel.

10 Claims, 16 Drawing Sheets

(51) Int. Cl.
*E06B 3/72* (2006.01)
*E04B 2/82* (2006.01)

(56) References Cited

U.S. PATENT DOCUMENTS 4,375,829 A * 3/1983 Dorr ..... A47G 5/00 160/135
4,594,829 A * 6/1986 Herrgord ..... E05D 1/04 52/282.3
4,845,911 A * 7/1989 Winston ..... E06B 3/68 52/456
5,105,594 A * 4/1992 Kirchner ..... A47G 5/00 52/239
5,339,576 A * 8/1994 Fussler ..... E04B 2/7429 160/135
5,502,930 A * 4/1996 Burkette ..... E04B 2/7429 16/225
5,657,591 A * 8/1997 Kitada ..... E06B 3/5454 49/501
5,803,146 A * 9/1998 Boon ..... E04B 2/7416 160/135
6,619,364 B1 * 9/2003 Ehrlich ..... E04B 2/7427 16/94 R
8,261,500 B2 9/2012 Sprague
2005/0235568 A1 * 10/2005 Holmstrom ..... E05F 7/04 49/372
2007/0251180 A1 11/2007 Gosling et al.
2009/0100997 A1 * 4/2009 Fuqua ..... F41H 5/013 89/36.02
2009/0145039 A1 * 6/2009 Shehoski ..... E05D 15/063 49/409
2010/0132895 A1 * 6/2010 Logue ..... A47B 46/005 160/127
2014/0075853 A1 3/2014 Keller et al.

* cited by examiner

DETAIL A

DETAIL B

DETAIL C

CUSTOMIZABLE CLOSURE SYSTEM

CROSS-REFERENCE TO RELATED APPLICATION

Pursuant to 35 U.S.C. § 119(e), this application claims the benefit of U.S. Provisional Patent Application Ser. No. 61/990,770, filed on May 9, 2014, U.S. Provisional Patent Application Ser. No. 62/067,944, filed on Oct. 23, 2014, and U.S. Provisional Patent Application Ser. No. 62/116,767, filed on Feb. 16, 2015, the entire contents of each of which are incorporated herein by this reference.

BACKGROUND (1) Field of Invention

This invention relates generally to closure devices and divider panels, and more particularly, to a customizable closure system configurable to application-specific needs.

(2) Background

Disclosed herein is a multifunctional customizable closure system for rooms or areas within buildings or enclosed areas. Past room dividers and room closure devices are suitable for single purpose use only. For example, movable partition walls are not suitable as closure devices for other areas, such as showers or outdoor patio units exposed to the weather. Water resistant panels are heavy and too cumbersome to serve as stand-alone room dividers. As a result, home owners and building owners must purchase multiple divider panels, doors, and enclosure walls to configure building space as desired.

The present invention solves these problems by providing a multifunctional, customizable closure system and conversion kits capable of being configured as a stand-alone partition, a room divider, a bypass door assembly, a swing door, or a hanger panel.

SUMMARY OF THE PREFERRED EMBODIMENTS

The system generally comprises one or more panels having a frame, and at least one conversion kit, where the panels and conversion kits are combined to form a closure or room divider, as desired. The one or more conversion kits comprise at least a room divider conversion kit, a bypass conversion kit, and a swing conversion kit. The room divider conversion kit comprises a hinge member that mates with the frame of a panel. The hinge member attaches to the frame.

The bypass conversion kit comprises a header and one or more hanger bracket assemblies for suspending the panels. The header comprises rails disposed inside a housing. The header is securely attached to the frame of a structure. The hanger bracket assemblies comprise at least one roller for rolling along the rails of the header, and a securement member for securely attaching to and retaining the panels. The panels are attached to the one or more hanger bracket assemblies via the securement members. The panels are then suspended from the header by inserting the hanger bracket assemblies into the housing of the header, and then seating the rollers on the rails. The panels can then be adjusted laterally by pushing the panels along the direction of the header. In one or more other embodiments of the bypass conversion kit, the kit further comprises wall jambs, bumpers, a sill assembly, a seal member, and a hand bar assembly.

The panels are sized as needed for the particular application of the customizable closure system. For example, preselected panes can be arranged in a 3×4 array in a panel intended for use as a shower door or a high room bypass or room divider. A 3×3 array of panes is used for panels intended for tub closures or lower room bypass or room dividers. A 2×4 array of panes is used for a higher, narrower panel for use in certain shower closures or as room dividers. The closure system is customizable by selection the number and type of panels and conversion kits needed for a desired application. One embodiment of the panels further comprises a reinforcing system for securely retaining the panes with the panel.

In another embodiment of the closure system, the frame is an H-shaped member comprising connection legs spaced apart and retained by a web, which is the cross member of the H-shape. In another embodiment of the frame, an anchor member of the web comprises a C-shaped channel having a flat abutting surface oriented transverse to the legs, where the abutting surface enables a compact profile of the frame.

In another embodiment, the closure system further comprises a swing conversion kit. The swing conversion kit comprises components that enable the panels to swing freely, thereby functioning as swing doors. The swing conversion kit comprises an anchor unit and a hinge post. The anchor unit is an elongate member that is securely attached to the frame. The anchor unit comprises anchor extension flanges oriented to snugly mate with the legs of the frame. The side of the anchor unit opposite that of the anchor extension flanges comprises a C-shaped recess for receiving a mating hinge rod from the hinge post.

The hinge post comprises a hinge rod having an extension with a C-shaped head, which is sized to snugly mate with and fit within the C-shaped recess of the anchor unit. The hinge post further comprises hinge extension flanges for snugly and securely mating with corresponding flanges on a wall jamb member. The wall jamb member is anchored to the frame of the opening which is to be enclosed, such as a door frame.

In another embodiment, the swing conversion kit further comprises a closure assembly. The closure assembly is configured for releasably retaining the swing door panel in a closed position until the user desires the door panel to open. For example, the closure assembly comprises magnetic closures, hooks, clasps, latches, or the like for releasably retaining the panel in a closed position.

In another embodiment of the closure assembly, the assembly comprises a closure interface member and a jamb connection unit. The closure interface member comprises connection extension flanges for snugly mating with the legs of the frame. The connection unit further comprises a jamb contact member for mating with a corresponding member on the jamb connection unit. The jamb connection unit comprises jamb extension flanges for snugly and securely mating with corresponding flanges on a wall jamb member. The jamb connection unit further comprises a jamb connection member for mating with the jamb contact member on the connection unit. In another embodiment of the closure assembly, the jamb contact member and the jamb connection member are replaced with stops, or strikes, to provide a door strike for the swinging panels.

In another embodiment, the closure system further comprises a hanger conversion kit having a hanger extension flange supported by a base extender. The base extender mates with the frame in a manner that securely connects the frame with the hanger conversion kit. The hanger extension flange cantilevers from the base extender in a direction opposite that of the extender legs. The hanger extension flange can be attached to door frames, buildings, or the like so that the panel hangs from the hanger conversion kit.

DETAILED DESCRIPTION OF THE PREFERRED EMBODIMENTS

With reference to the drawings, the closure system will now be described with regard for the best mode and the preferred embodiments. In general, the device disclosed herein is a customizable closure system having multiple conversion kits for customization. The embodiments disclosed herein are meant for illustration of the device, and not for limitation of the inventive scope. An ordinary practitioner will appreciate that it is possible to create many variations of the following embodiments without undue experimentation.

Figure 1:
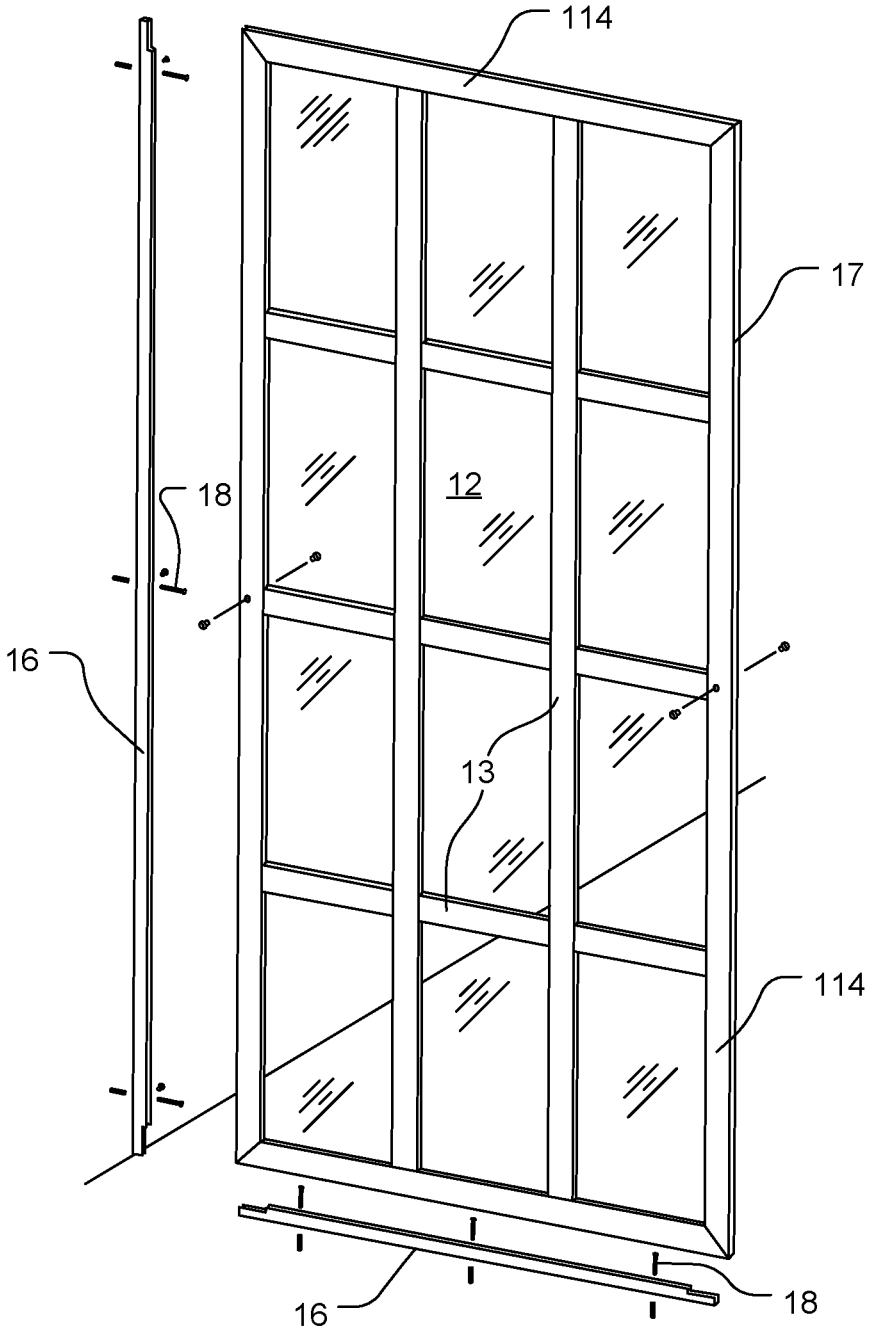
FIG. 1 is an isometric view of a typical panel of the customizable closure system.

Referring to FIG. 1, the system generally comprises one or more panels 10 and one or more conversion kits. Depending on the application of the customizable system, at least one panel 10 and at least one conversion kit are combined to form a doorway closure or room divider, as desired. For example, the system can be customized so that the panel 10 functions as room dividers, bypass dividers, swing door closures, or the like.

In one embodiment, the panels 10 comprise panes 12 arranged in rows and columns to form an array. The panes 12 are supported by horizontal and vertical retaining members 13. The array of panes 12 is further supported by frame 114, and the frame 114 is configured to mate with an interface member 15 of one of the conversion kits. In other embodiments, the panels 10 are a single column of wide rectangular panes 12, and in this embodiment there are no vertical retaining members 13. In this embodiment, the panes 12 are supported by horizontal retaining members 13 and the frame 114. In another embodiment, the panels 10 comprise a single row of tall rectangular panes 12. In this embodiment, the panes 12 are supported by vertical retaining members 13 and the frame 114, without any horizontal retaining members 13. An ordinary practitioner will appreciate that a wide variety of arrangements of the array fall within the scope of the panels 10.

The interface member 15 is one of the jambs or other connection members included within one of the conversion kits. The interface member 15 comprises a first side and a second side, the first side having a frame connection member and the second side having a kit connection member, thereby functioning as a mechanical interface between the frame 114 of the panel 10 and the conversion kit components. Various embodiments of the panes 12 include glass, plastic, or other transparent or translucent material. Other embodiments of the panes 12 include wood, bamboo, or the like. In embodiments where the panels 10 are to be used as watertight members, such as for shower doors, the panes 12 are glass or plastic and have a watertight seal between the panes 12 and the retaining members 13, and between the panes 12 and the frame 114.

The frame 114 of the panels 10 is configured to receive one or more cover members 16, which are post-like members seated within a channel recess of the frame 114. In one embodiment, shown in FIG. 9, the frame 114 comprises members having a web 105 spanning between two flanges 106 in a substantially H-shaped cross section such that the frame 114 member comprises a first channel recess 117*a* for mating with the panel 10 and a second channel recess 117*b* for mating with the interface member 15 or cover member 16. The web 105 of the frame 114 comprises a C-shaped recess 108. In one embodiment, the end of the flanges 106 comprises barbs 137 for mating with various components of the closure system described below.

Referring again to FIG. 1, the cover members 16 are retained within the channel recess 17 by mechanical fasteners, the surface friction of a snug fit, or the equivalent mechanism. If desired, additional mechanical fasteners 18 are used to anchor the cover members to the floor or wall of a structure so that the panel 10 acts as a partition wall. In most embodiments of the panels 10, the cover members 16 are located on the bottom and one side of the panel 10, although the frame 114 is configured to receive cover members 16 on both sides and the top as well. In one embodiment, the cover members 16 mate with the interface member 15 to mount the panel 10. In other embodiments, the cover members 16 are removed from the frame 114 to enable a direct connection between the frame 114 and the interface member 15, as described below.

Figure 2:
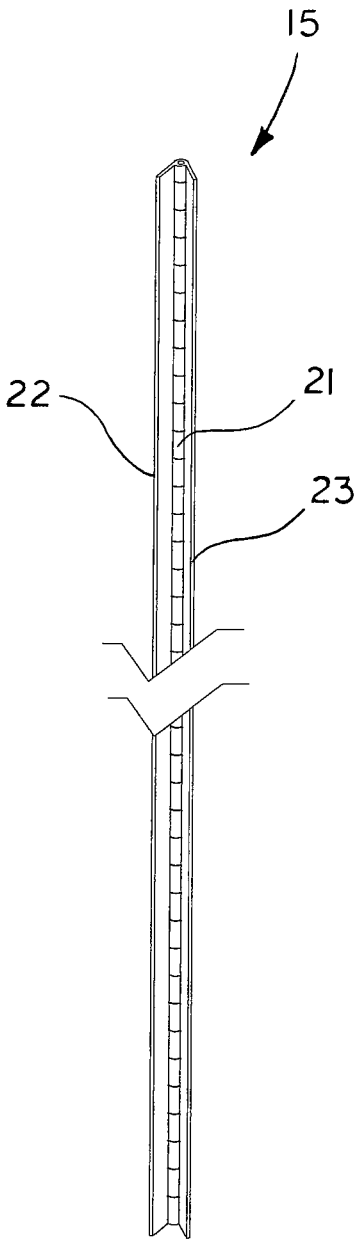
FIG. 2 is an isometric view of one embodiment of a room divider conversion kit.
Figure 3:
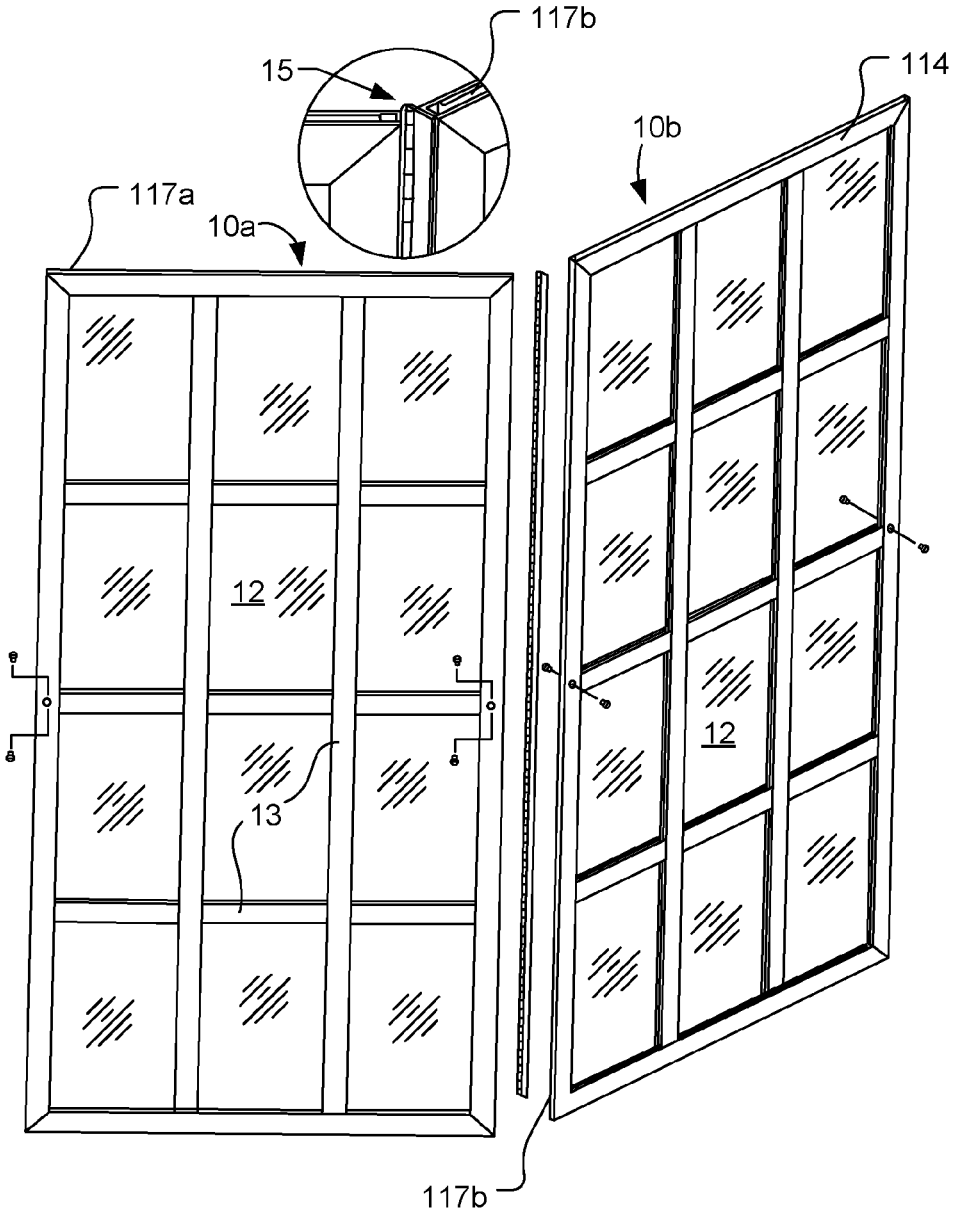
FIG. 3 is an exploded view of two panels combined by a room divider conversion kit.

The one or more conversion kits comprise at least a room divider conversion kit 20, a bypass conversion kit 30, and a swing conversion kit 120. The room divider conversion kit 20, shown in FIGS. 2 and 3, comprises a hinge member 21 that mates with the frame 114 of a panel 10. In one embodiment, the hinge member 21 is a piano hinge, or a similar hinge, extending along the frame 114 between adjacent panels 10. The hinge member 21 is configured to attach to the cover member 16 or to the frame 114, as desired. The hinge member 21 is connected to the panels 10 by one or more hinge screws, as needed.

In one embodiment, the room divider conversion kit 20 comprises a hinge member 21 having a first hinge plate 22 that functions as the frame connection member, the first hinge plate 22 configured to mate with the second channel recess 117*b* of the frame 114 of a first panel 10*a*, and a second hinge plate 23 that functions as the kit connection member, the second hinge plate 23 configured to mate with the second channel recess 117*b* of a second panel 10*b*.

Figure 4:
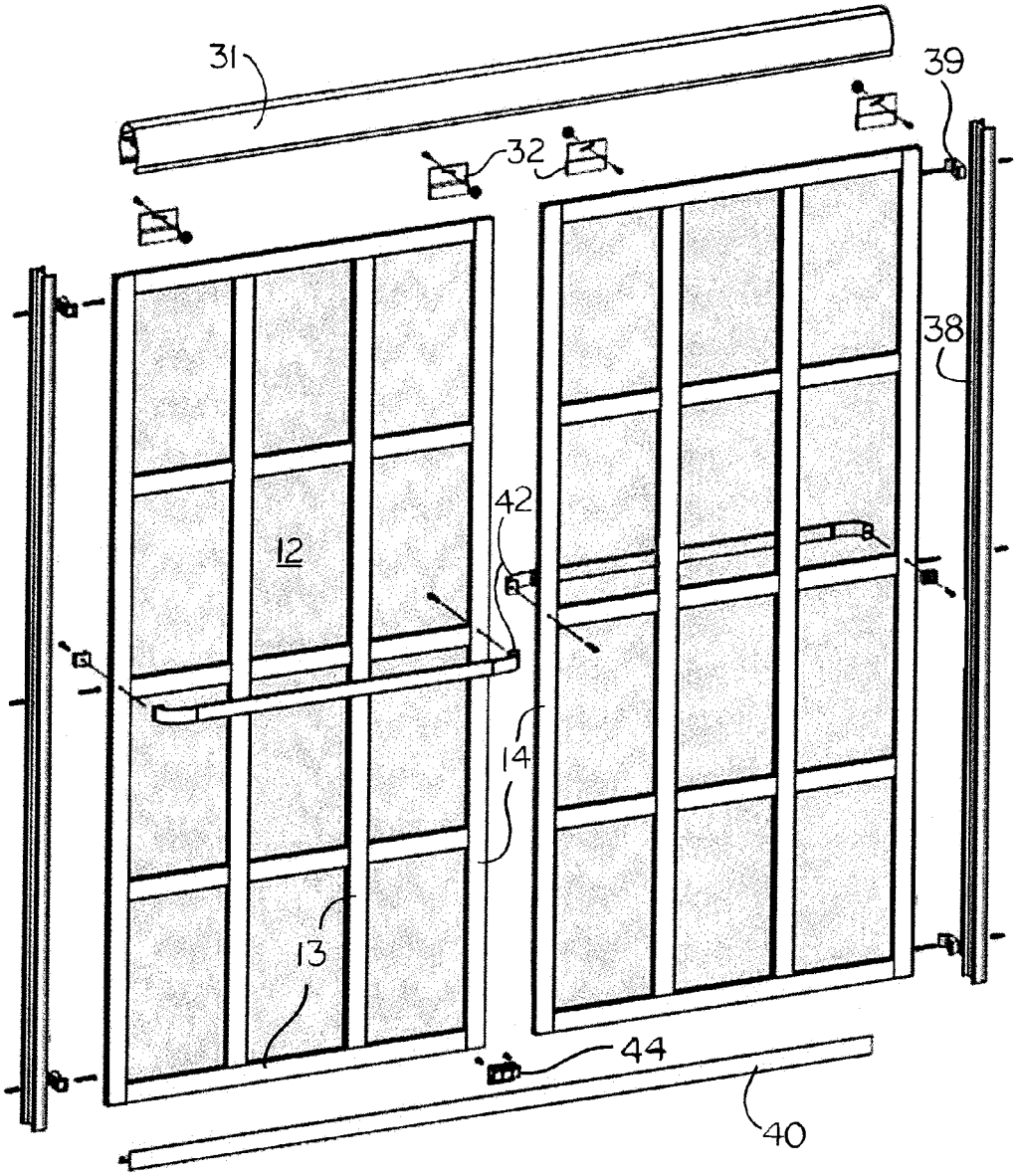
FIG. 4 is and exploded view of two panels combined with a bypass conversion kit.
Figure 5:
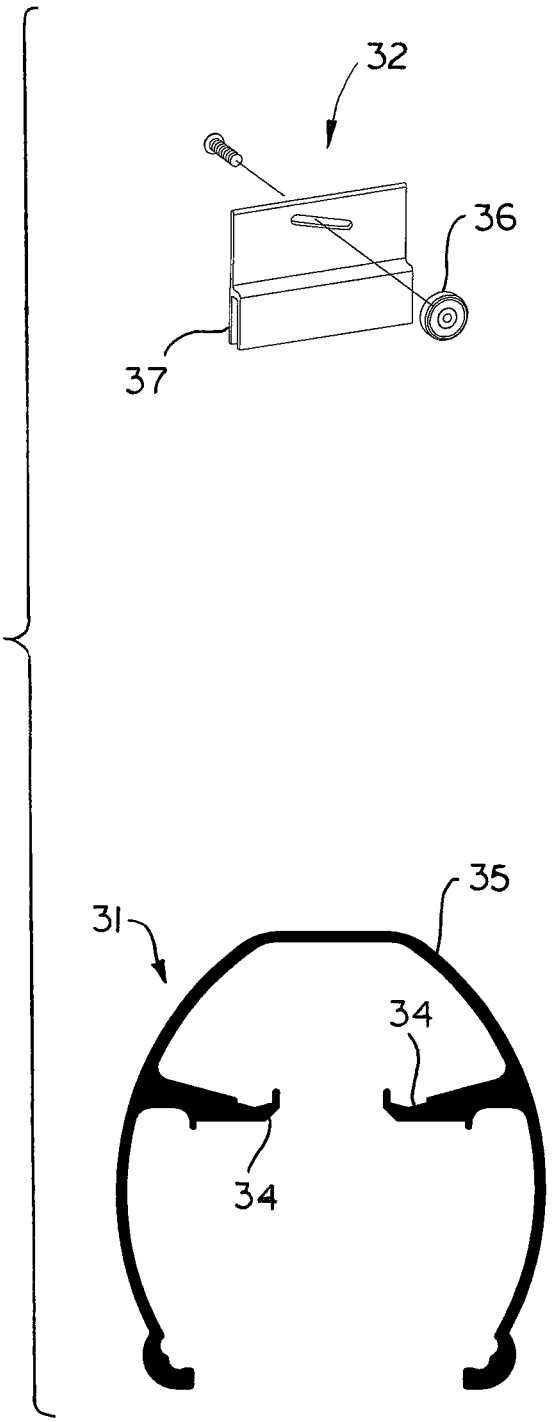
FIG. 5 is a parts list of components included in one embodiment of a bypass conversion kit.

Referring to FIGS. 4 and 5, the bypass conversion kit 30 comprises a header 31 and a bypass interface member comprising one or more hanger bracket assemblies 32 for suspending the panels 10. The header 31 comprises rails 34 disposed inside a housing 35. The header 31 is securely attached to the frame of a structure, such as a house or a shower closure area (not shown).

The hanger bracket assemblies comprise a frame connection member that is a pair of flanges 37 configured for snug insertion into the second channel recess 117*b* of the frame 114 of the panel 10, and the kit connection member comprises at least one roller 36 configured to be seated on the rail 34 of the header 31. The roller 36 is configured for rolling along the rails 34 of the header 31. The panels 10 are attached to the one or more hanger bracket assemblies 32 via the flanges 37, such as by clamping, gluing, or mechanically fastening the flanges 37 to the frame 114 or cover members 16 of the panels 10.

The panels 10 are then suspended from the header 31 by lifting the panels 10 to insert the hanger bracket assemblies 32 into the housing of the header 31, and then seating the rollers 36 on the rails 34. The panels 10 can then be adjusted laterally by pushing the panels 10 along the direction of the header 31. The rollers 36 roll along the rails 34, thereby allowing adjustability and movability of the panels 10.

In one or more other embodiments of the bypass conversion kit 30, the kit 30 further comprises wall jambs 38, bumpers 39, a sill assembly 40, a seal member, and a hand bar assembly 42. The wall jambs 38 are securely connected to a structural frame, such as the frame of a house or shower closure area (not shown). The bumpers 39 are connected to the wall jambs 38 such that the panels 10 contact the bumpers 39 as the panels 10 approach the end of the header 31 when the panels 10 are moved in a lateral motion. The bumpers 39 are attached to the wall jambs 38 with mechanical fasteners or by an equivalent method.

The sill assembly 40 comprises a sill member attached to the base of the structural frame or shower closure. In applications where the panels 10 are intended to prevent water leakage, the sill assembly 40 further comprises a seal member attached to the sill assembly 40. The seal member is a rubber or plastic strip extending the length of the sill assembly 40 such that any water dripping from the panels 10 is retained by the seal member and channeled back into the shower area. The sill assembly 40 can further comprise a panel guide 44, which is a short, U-shaped channel having a downward extending flange. The flange is securely connected to the sill assembly 40, and the U-shaped channel is oriented such that the bottom edge of the panels 10 fits snugly within the U. The panel guide 44 thereby braces the panels 10 against undesired movement perpendicular to the direction that the panels 10 are being slid, or perpendicular to the longitudinal direction of the header 31.

The hand bar assembly 42 typically comprises a hand bar and the hardware for attaching the hand bar to one or more of the panels 10. Finger pull members, mechanical anchors and screws, and other typical members are used as needed to securely attach the hand bar to the panels 10 for its desired use.

Figures 6A, 6B, 6C:
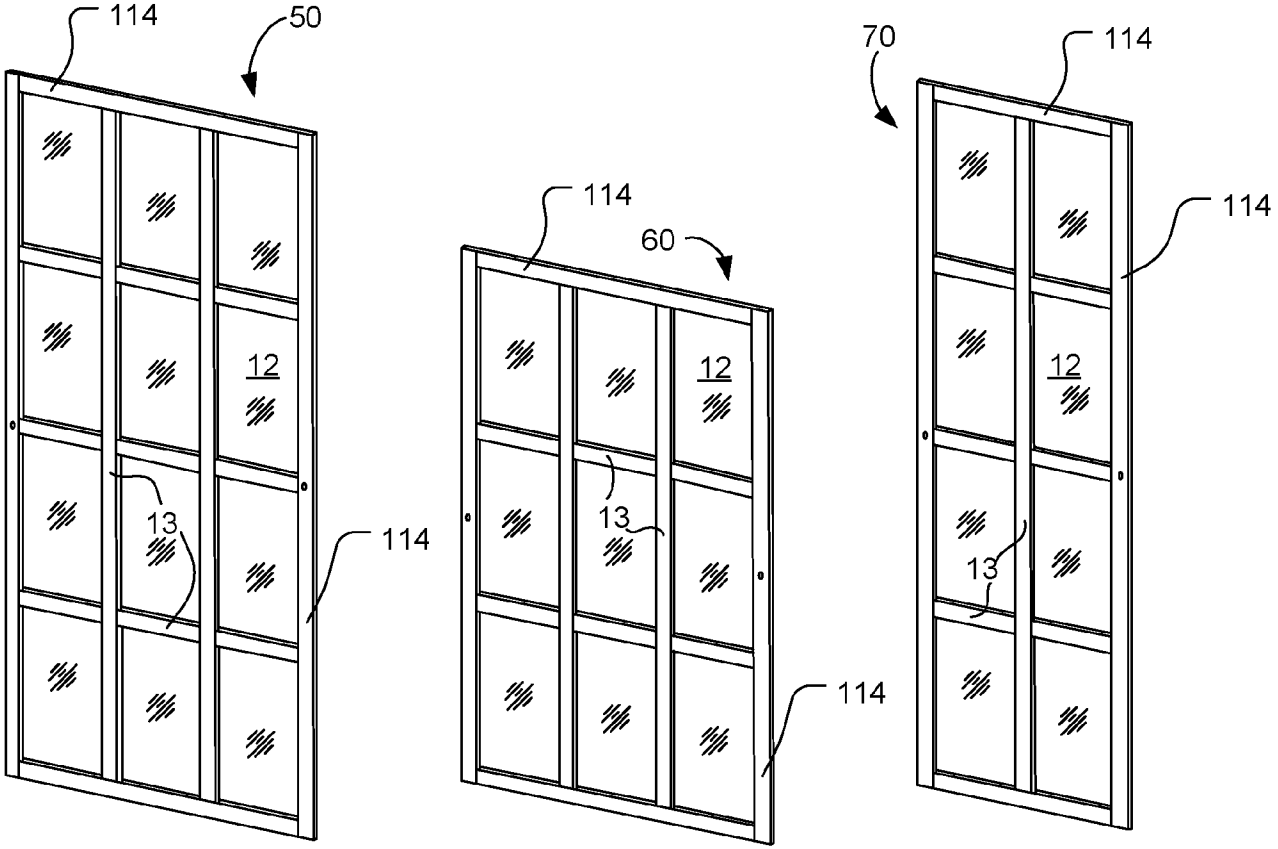
FIGS. 6A-6C show isometric views of various embodiments of panel arrays of the customizable closure system.

Referring to FIGS. 6A-6C, the panels 10 are sized as needed for the particular application of the customizable closure system. In one embodiment, preselected panes 12 can be arranged in a 3×4 array in a panel 50 intended for use as a shower door or a high room bypass or room divider. In another embodiment, 3×3 array of panes 12 is used for panels 60 intended for tub closures or lower room bypass or room dividers. In another embodiment, a 2×4 array of panes 12 is used for a higher, narrower panel 70 for use in certain shower closures or as room dividers.

The closure system is customizable by selection the number and type of panels 10 and conversion kits needed for a desired application. For example, a user may select two panels 50 and a room divider conversion kit 20 to arrange the panels 50 in an orientation to partition a room or to conceal object from the view of passers-by. Alternately, a user could select one panel 50, two panels 70, and bypass conversion kits 30 to arrange the three panels as a closure for a custom shower area. At points of retail sale, the panels 50, 60, and 70 can be sold in standard sizes along with standard conversion kits. The user can select the panels and conversion kits needed for the intended use of the closure system.

Figure 7:
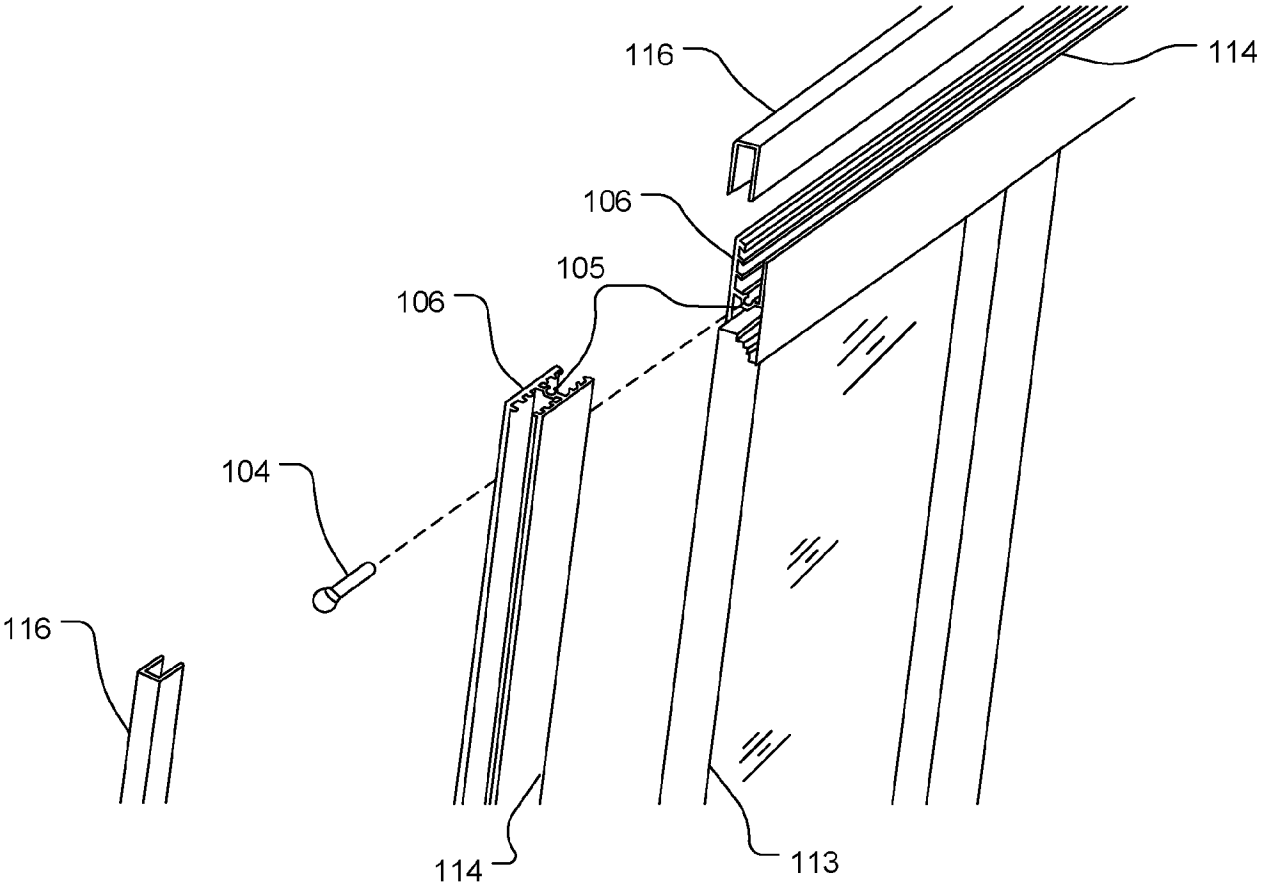
FIG. 7 is an exploded view showing one embodiment of the frame of a panel connection.
Figure 8:
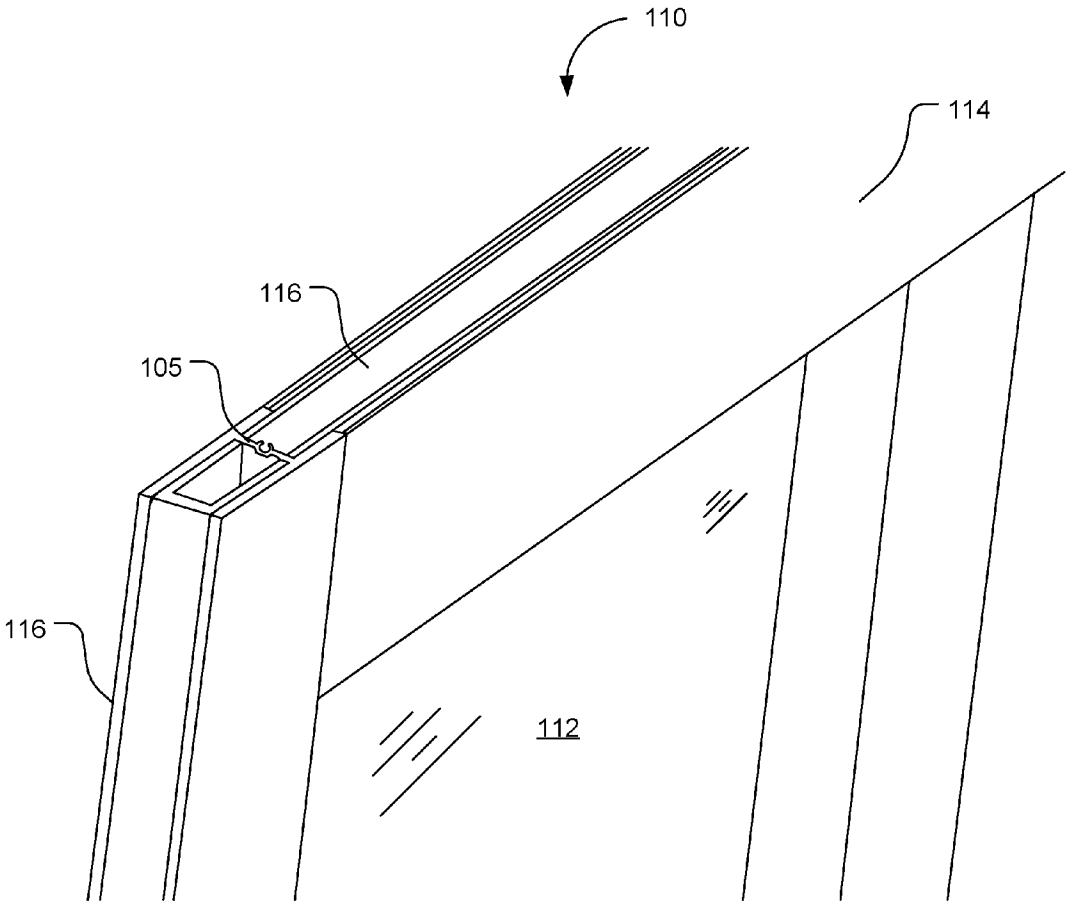
FIG. 8 shows the assembled frame with a cover member connected to the frame.

Referring to FIGS. 7-8, and as described above, in one embodiment the frame 114 comprises members having a web 105 spanning between two flanges 106 in a substantially H-shaped cross section such that the frame 114 member comprises a first channel recess 117*a* for mating with the panel 10, and a second channel recess 117*b* for mating with the interface member 15. The web 105 of the frame 114 comprises an anchor member 107, such as a C-shaped recess 108. In one embodiment, the flanges 106 and the wall jamb members 127 further comprise barb members 137 for providing a secure connection with the respective extension flanges on the members with which they mate. The barb members 137 increase the friction between the flanges 106 (or the wall jamb members 127, as appropriate) and the mating extension flanges, thereby retaining the extension flanges securely from being inadvertently dislodged. Preferably, one or more barbs 137 are directed inwardly and toward the web 105. In one embodiment, the end of the flanges 106 comprises barbs 137 for mating with various components of the closure system.

Figure 9:
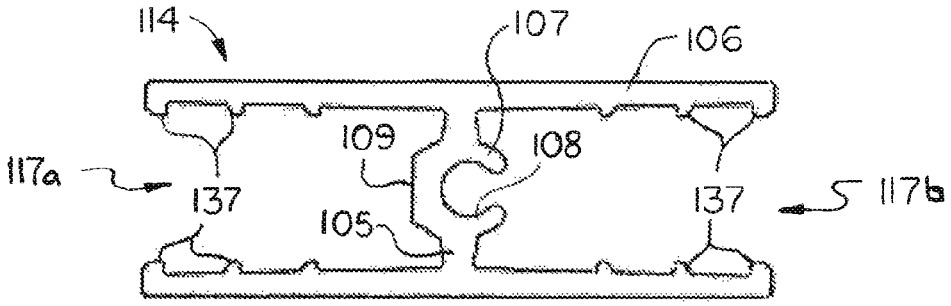
FIG. 9 is a cross section of one embodiment of a frame member.

In one embodiment of the frame 114, the anchor member 107 is a member for anchoring a connecting member to the web 105. The connecting member could be a mechanical fastener, a mating extension from another member, or the like. For example, in one embodiment, the anchor member 107 comprises a C-shaped channel 108 having a flat abutting surface 109 oriented transverse to the flanges 106, where the abutting surface enables a compact profile of the frame 114. The anchor member 107 enables efficient and effective connection to the other members of the closure system. In this embodiment, the abutting surface 109 of the channel 108 is placed against the retaining member 113 of the panes 112, as shown in FIGS. 8 and 9. The web 105 has one or more holes for receiving a mechanical fastener 104. At a corner of the frame 114, a vertical frame 114 member and a horizontal frame 114 member adjoin at a substantially right angle. The angle may vary from 90-degrees due to out-ofplumb alignment of jamb members or door frames. Alternately, the adjoining frame 114 members could be mitered at some other angle, such as 45-degrees.

Figure 10:
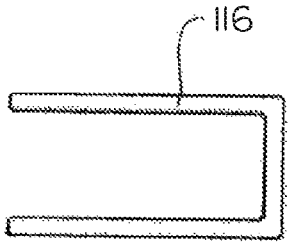
FIG. 10 is a cross section of one embodiment of a cover member.

In one embodiment, shown in FIG. 7, the holes in the vertical web 105 are aligned with the channel 108 of the horizontal frame 114 member, such that a mechanical fastener 104 installed through the hole in the web 105 of the vertical frame 114 member is anchored into the channel 108 of the horizontal frame 114 member. The mechanical fastener 104 and the channel 108 can further comprise threads to enable a secure connection. In an alternate embodiment, the channel 108 comprises a soft metal and the mechanical fastener 104 comprises a harder metal that becomes self-tapping as it is driven into the softer metal of the channel 108. The cover member 116 is then placed in the extending flanges 106 of the frame 114 to cover the recess in a manner that protects the interior of the frame 114 from debris and conceals it from view. The cover member 116, shown in FIG. 10, is sized to make a snug fit inside the channel recess 117 of the frame 114, and the barbs 137 provide additional surface friction to removably retain the cover member 116 securely in place.

Figure 12:
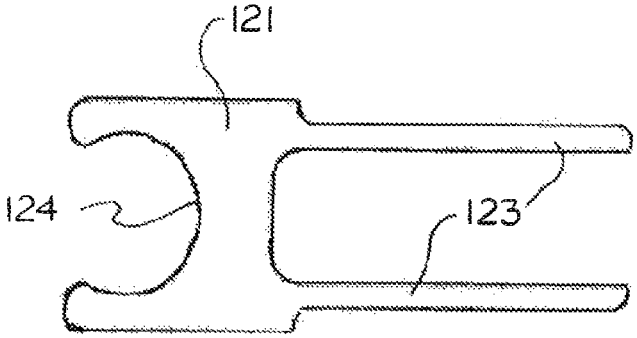
FIG. 12 is a cross section of one embodiment of a swing interface member.
Figure 11:
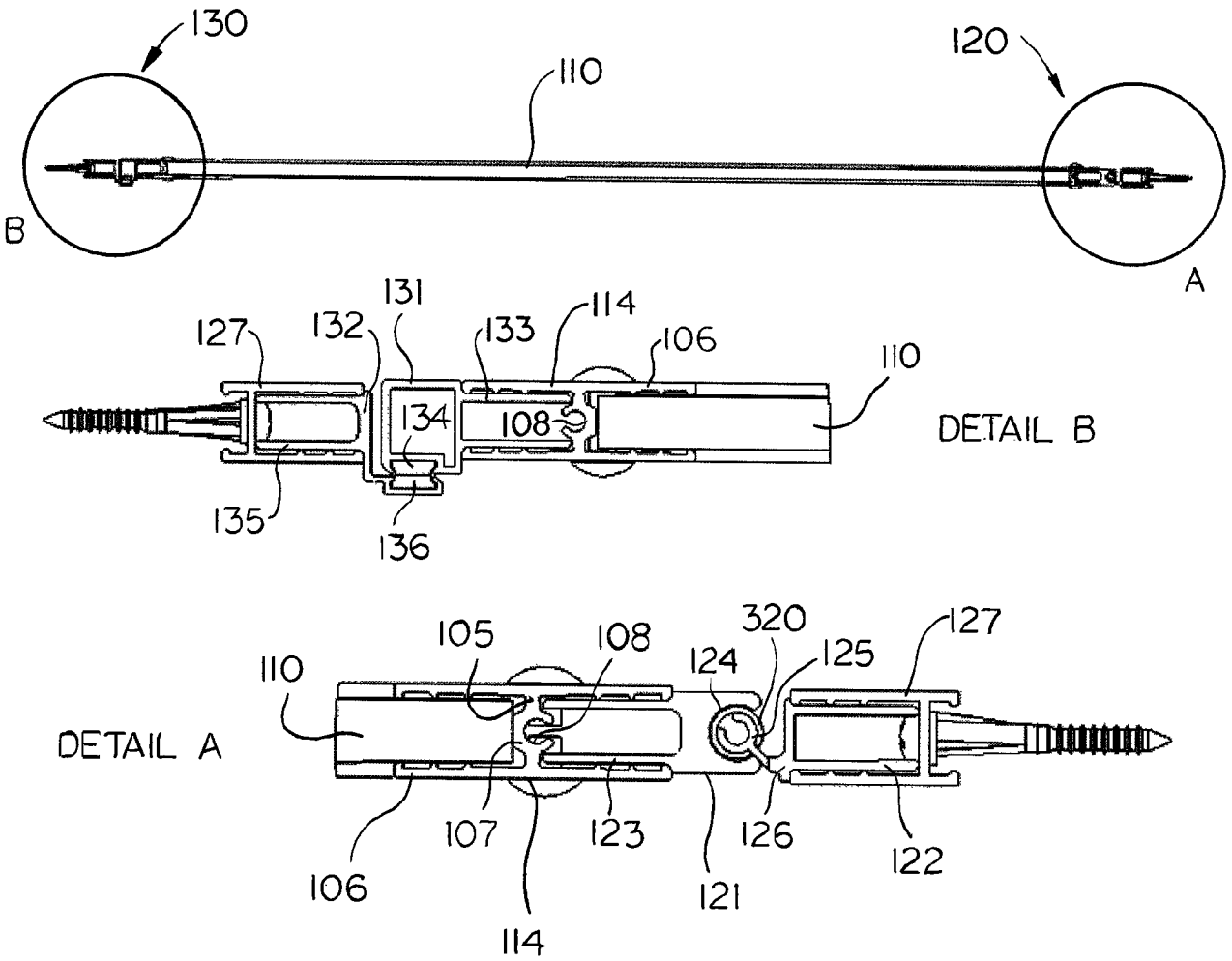
FIG. 11 is a cross section of a panel having a swing conversion kit and a closure assembly attached to the panel.
Figure 13:
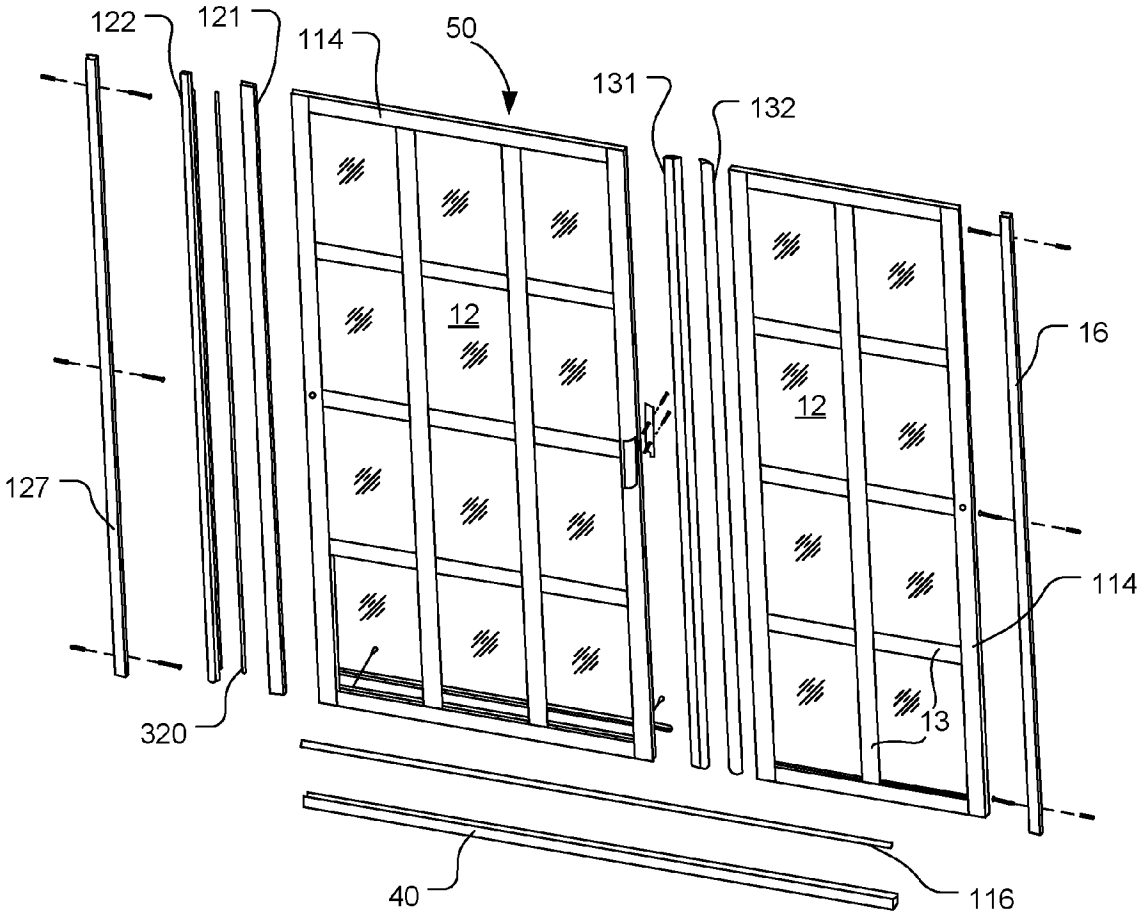
FIG. 13 is an exploded view of one embodiment of a swing conversion kit according to the principles of the invention.
Figure 14:
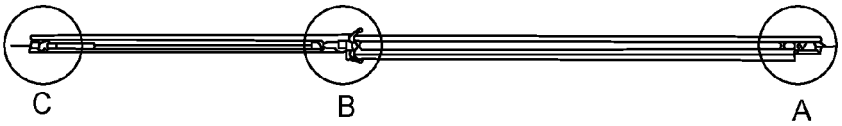
FIG. 14 shows detailed cross sections of one embodiment of a swing conversion kit.
Figure 14:
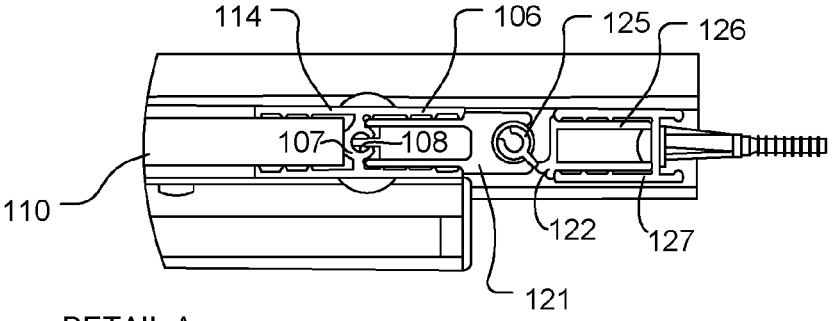
Figure 14:
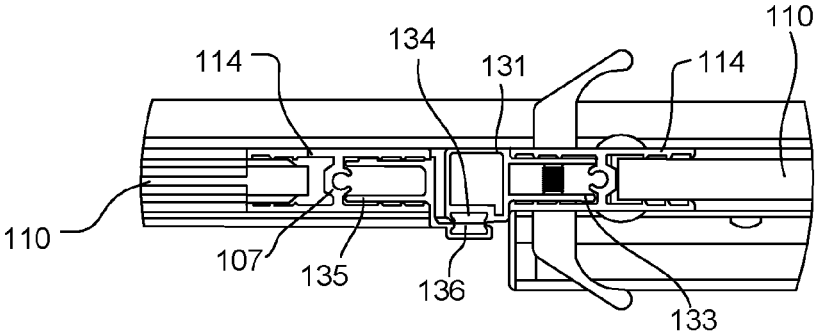
Figure 14:
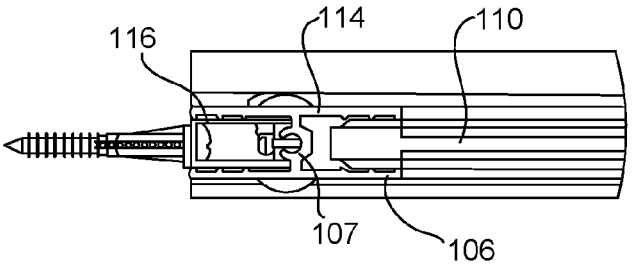

In another embodiment, shown in FIGS. 11-14, the closure system further comprises a swing conversion kit 120. The swing conversion kit 120 comprises components that enable the panels 110 to swing freely, thereby functioning as swing doors. The swing conversion kit 120 comprises a swing interface member 121 and a hinge post 122. The swing interface member 121 is an elongate member, such as a hinge stile, that is securely attached to the frame 114. In most instances of the swing conversion kit 120 embodiment, the swing conversion kit 120 is attached to the panel 110 along one of the vertical sides of the panel 110. The swing interface member 121 can be disposed continuously or intermittently along the vertical side of the frame 114 as desired. The frame connection member of the swing interface member 121 comprises anchor extension legs 123 oriented to snugly mate with the flanges 106 of the frame 114, as shown in FIGS. 11 and 12. Preferably, the extension legs 123 fit inside the flanges of the frame 114 channel recess 117, and the members are removably attached by surface friction. Mechanical anchors can also be used to ensure a secure connection. The kit connection member of the swing interface member 121 comprises a C-shaped recess 124 for receiving a mating hinge rod 125 from the hinge post 122. The hinge rod 125 is a tube member about which the hinge rotates, and it is sized to fit inside the C-shaped recess 124. The hinge rod 125 could be a C-shaped rod attached to the swing interface member by a stem.

The hinge post 122 has a first side and a second side, the first side comprising a hinge rod 125 having an extension with a C-shaped head, which is sized to mate with and fit within the C-shaped recess 124 of the swing interface member 121. The second side of the hinge post 122 comprises one or more hinge extension flanges 126 for snugly and securely mating with corresponding flanges on a wall jamb member 127. The wall jamb member 127 is anchored to the frame of the opening which is to be enclosed, such as a door frame.

In another embodiment, the swing conversion kit 120 further comprises a closure assembly 130. The closure assembly 130 is configured for releasably retaining the swing door panel 110 in a closed position until the user desires the door to open. For example, the closure assembly 130 comprises magnetic closures, hooks, clasps, latches, or the like for releasably retaining the panel 110 in a closed position. Although the closure assembly 130 can extend for the entire vertical length of the panel 110, it is not necessary to do so. In one embodiment, the closure assembly 130 extends only for a few inches along one of the vertical sides of the panel 110, preferably near the midpoint of the vertical side.

In one embodiment of the closure assembly 130, the assembly 130 comprises a closure interface member 131 and a jamb connection unit 132. The frame connection member of the closure interface member 131 comprises extension flanges 133 for snugly mating with the flanges 106 of the frame 114, as described above. The kit connection member of the closure interface member 131 comprises a jamb contact member 134, such as a magnet, a hook, a clasp, a latch, or the like, for mating with a corresponding member on the jamb connection unit 132. The jamb connection unit 132 comprises jamb extension flanges 135 for snugly and securely mating with corresponding or mating flanges on a wall jamb member 127. The jamb connection unit 132 further comprises a jamb connection member 136 for mating with the jamb contact member 134 on the closure interface member 131.

In another embodiment of the closure assembly 130, the jamb contact member 134 and the jamb connection member 136 are replaced with stops, or strikes, to provide a door strike for the swinging panels 110. For example, the magnets used as closure devices are replaced with rubber members so that the swinging panels 110 are prevented from over-swinging without causing any damage to the panels 110, the frame 114, or any of the other components of the closure system.

Figure 15:
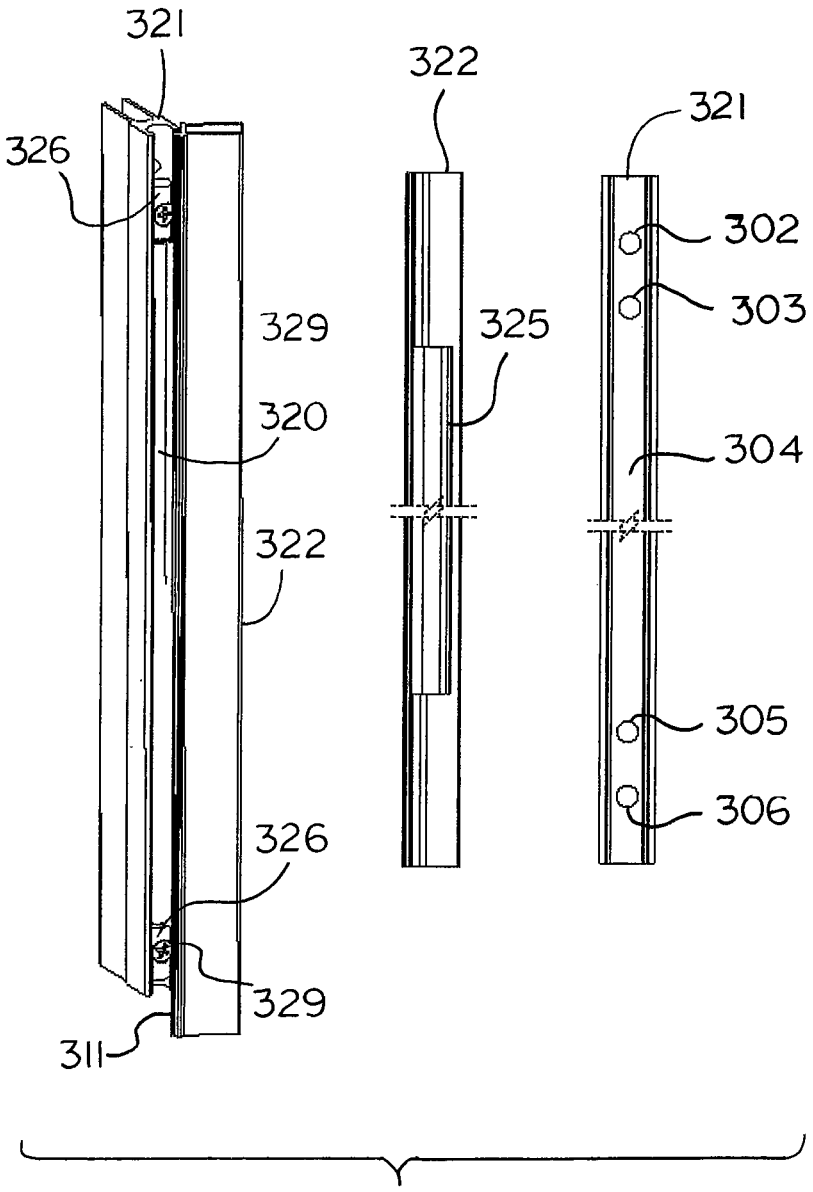
FIG. 15 shows connection details for one embodiment of a swing conversion kit.
Figure 16:
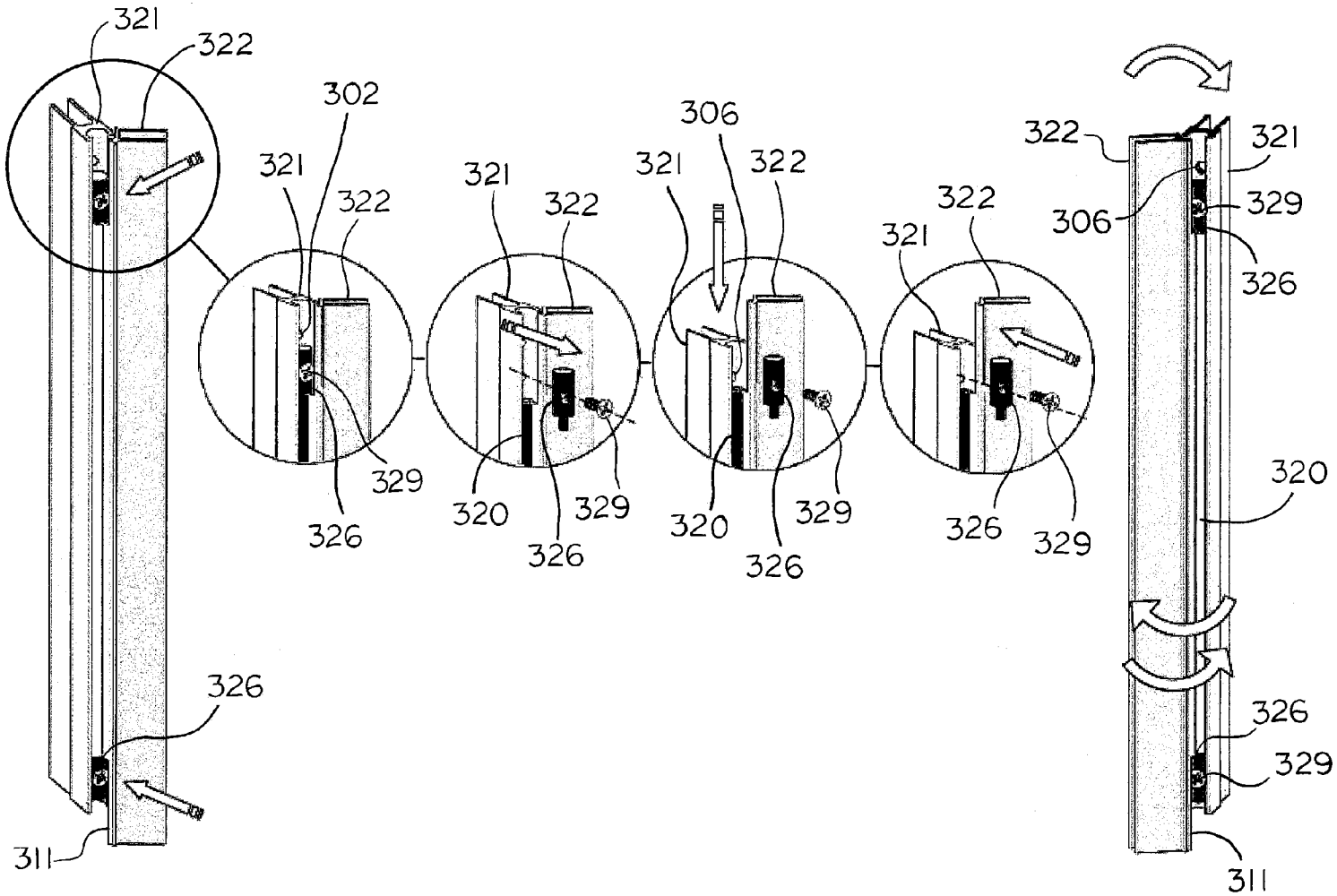
FIG. 16 shows a conversion sequence for one embodiment of a hinge assembly for a swing conversion kit.
Figure 17:
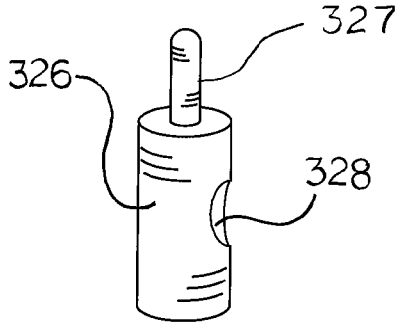
FIG. 17 shows an isometric view of a hinge pin for the swing conversion kit.

In one embodiment of the swing door conversion kit, shown in FIGS. 15-16, the swing interface member 321 and the hinge post 322 are connected together by two hinge pins. The swing interface member 321 has a first fastener hole 302, a second fastener hole 303, a third fastener hole 305, and a fourth fastener hole 306. These fasteners holes are disposed within an open faced, partially circular receiving slot 304 connected to the swing interface member 321. The hinge post 322 has a hollow hinge rod 325 connected to the hinge post 322 by a stem. In some embodiments, the hinge rod 325 takes a form having a C-shaped cross section. The hinge pin comprises a body 326 connected to an insert 327, which is a peg-like member (see FIG. 17). The body 326 has a receiving hole 328 for receiving a mechanical fastener 329. The receiving slot 304 is sized to snugly receive the body 326 of the hinge pin.

In one method of assembling the hinge, a hinge pin is inserted into the receiving slot 304 from the top with the insert 327 pointed downward, and another hinge pin is inserted into the receiving slot 304 from the bottom with the insert 327 pointed upward. The receiving hole 328 of the top hinge pin is aligned with the first fastener hole 302, and the fastener 329 is inserted through both holes to retain the hinge pin in place within the receiving slot 304. The receiving hole 328 in the bottom hinge pin is aligned with the fourth fastener hole 306, and a fastener 329 is inserted through both holes to retain the bottom hinge pin in place within the receiving slot 304.

The hinge rod 325 on the hinge post 322 runs partially along the length of the hinge post 322. The length of the hinge rod 325 is sized such that it can be placed between the opposing points of the inserts 327 of the secured hinge pins described above. The hinge post 322 is placed such that the hinge rod 325 is inserted into the receiving slot 304, and the hinge post 322 is raised until the insert 327 of the top hinge pin is inserted into the hollow portion of the hinge rod 325, where the insert 327 is sized to snugly fit inside the hinge rod 325. The fastener 329 of the lower hinge pin is released, and the receiving hole 328 is realigned with the third fastener hole 305, and the fastener 329 is reinserted through both holes to retain the bottom hinge pin in place. In this position, the insert 327 is inserted into the hinge rod 325, and the hinge rod 325 is seated against the body 326 of the lower hinge pin. The hinge stile 322 is then free to rotate with respect to the hinge post 322, and the assembly can then be attached to a door wall jamb.

As an alternative assembly method, the hinge post 322 is connected to the door wall jamb prior to attachment of the swing interface member 321. The connection method is similar to that described above, except that the swing interface member 321 is moved in relation to the fixed hinge post 322 to maneuver the hinge rod 325 in place with respect to the inserts 327 of the respective top and bottom hinge pins.

In some applications, it may be desirable to have one side of the panel 10 facing in a certain direction. For example, when the swing conversion kit 120 is used such that the panel 10 is a shower door, it may be desirable to have one side of the panel 10, such as a decorative side, facing away from the wet shower area, where the reverse water proof side remains facing the shower area. In other instances, some components of the closure system may arrive at the job site in a partially pre-assembled configuration, and disassembly is undesired to save project cost. In these types of applications, it may desirable for the panel 10 to maintain clearance over a base member or dam sill, such as in a show area. Therefore, in another embodiment of the swing conversion kit 120, the bottom of the hinge post 322 comprises an extension 311 with respect to the swing interface member 321. In this embodiment, the extension 311 enables the installed swing interface member 321 to maintain clearance over the base member, the dam sill, or other such bottom horizontal members as necessary or desired. The tops of the swing interface member 321 and the hinge post 322 should remain substantially flush with each other in these configurations. The placement of the fastener holes 302, 303, 305, and 306 allow for versatility of installation by enabling placement of the swing interface member 321 and the hinge post 322 in adjustable relation to each other. This allows the hinge post 322 to be placed on either the right side or the left side of a shower enclosure frame without requiring additional installation steps.

For example, in an embodiment where the panel 10 is configured to swing away from a shower enclosure area, the hinge post 322 of the present embodiment is configured for placement on either the right side or the left side of the shower entrance. In a first configuration, shown in FIG. 16, the hinge post 322 is configured for placement on the left side of the shower doorway frame when viewed from outside the shower area. The extension 311 extends below the bottom of the swing interface member 321. The top hinge pin is aligned with the second fastener hole 303, and the bottom hinge pin is aligned with the fourth fastener hole 306. In this configuration, the bottom of the hinge post 322 extends below the bottom of the swing interface member 321, thus forming the extension 311 at the bottom of the hinge post 322, while the tops of the swing interface member 321 and hinge post 322 remain substantially flush with each other.

For installation on the right side of the shower doorway frame, the swing interface member 321 and the hinge post 322 are placed upside down on the right side of the shower doorway frame. The swing interface member 321 is also oriented upside down such that the fourth fastener hole 306 is the highest fastener hole, and the first fastener hole 302 is the lowest fastener hole. The top hinge pin is aligned with the third fastener hole 305, and the bottom hinge pin is aligned with the first fastener hole 302. In this configuration, the bottom of the hinge post 322 extends below the bottom of the swing interface member 321, thus forming the extension 311 at the bottom of the hinge post 322, while the tops of the swing interface member 321 and hinge post 322 remain substantially flush with each other. The fastener holes 302, 303, 305, and 306 therefore enable standard swing interface member 321 and hinge post 322 member to be interchangeably placed on either the left side or right side of the shower closure doorway while maintaining a bottom extension 311 of the hinge post 322 and a flush top alignment of the members.

In more detail, again referring to FIG. 16, to move the hinge post 322 from the left side of the door to the right side of the door, the fastener 329 is removed from the top hinge pin, which was in the second fastener hole 303. The fastener 329 is also removed from the bottom hinge pin and the fourth fastener hole 306. The swing interface member 321 and hinge post 322 member are turned upside down, so that the fourth fastener hole 306 is at the top of the swing interface member 321 and the first fastener hole 302 is at the bottom of the swing interface member 321. The top hinge pin is placed in the receiving slot 304 so that the insert 327 enters the hinge rod 325, and the receiving hole 328 of the top hinge pin is aligned with the third fastener hole 305, which is now the second hole from the top of the swing interface member 321. The fastener 329 is placed through the receiving hole 328 and into the third fastener hole 305 to regain the hinge pin in place. The bottom hinge pin is aligned with and connected to the first fastener hole 302 by the fastener 329, as described above. The panel and swing conversion kit 120 assembly is now ready for attachment to the right side of the doorway frame with the extension 311 of the hinge post 322 extending below the swing interface member 321.

Figure 18:
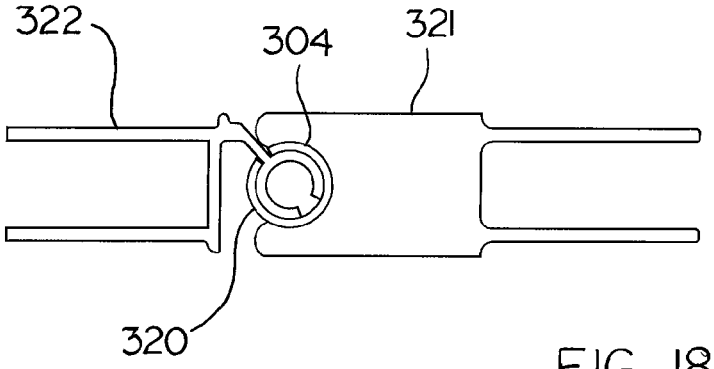
FIG. 18 is a cross section of one embodiment of the hinge post of a swing conversion kit.

In another embodiment, shown in FIG. 18, the hinge assembly further comprises a sleeve 320 having a C-shaped cross section (see also FIG. 11). The outer side of the sleeve 320 is sized to snugly fit inside the receiving slot 304 of the swing interface member 321, and the inner side of the sleeve 320 is sized to snugly receive the hinge rod 325. The sleeve 320 is made of a resilient material, such as a hard rubber or a plastic. The sleeve 320 permits rotatability in the hinge assembly by reducing friction between the hinge rod 325 and the receiving slot 304. The sleeve 320 is preferably disposed along the full length of the hinge rod 325, although partial or intermittent placement along the hinge rod 325 also enables adequate performance of the hinge assembly.

Figure 19:
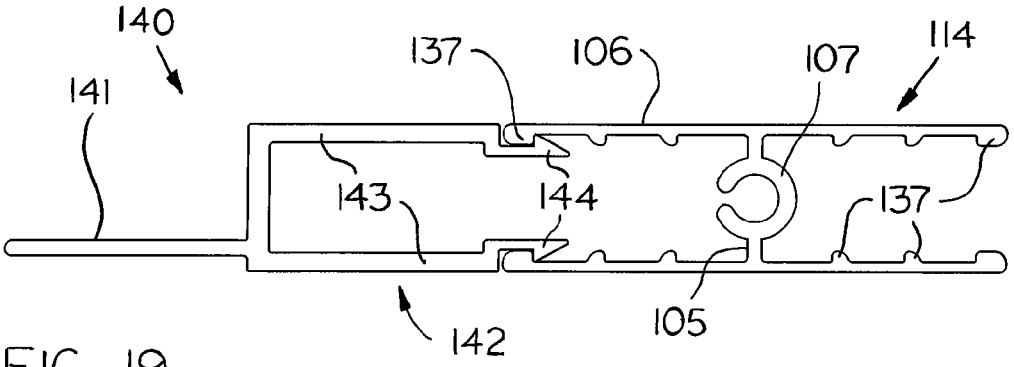
FIG. 19 is a cross section of one embodiment of a hanger conversion kit.

In another embodiment, referring to FIG. 19, the closure system further comprises a hanger conversion kit 140. The hanger interface member has an extension flange 141 as a kit connection member and a base extender 142 as the frame connection member. The base extender 142 mates with the frame 114 in a manner that securely and removably connects the frame 114 with the hanger conversion kit 140. For example, in one embodiment, the base extender 142 comprises a pair of extender legs 143, each extender leg 143 having connection barbs 144 for mating with and releasably connecting to the barb members 137 in the flanges 106 of the frame 114. The extender legs 143 of the base extender 142 are forcibly inserted into the flanges 106 of the frame 114 until the connection barbs 144 of the base extender 142 snap into a mating connection with the barb members 137. The base extender 142 is removed from the frame 114 by applying equal and opposite lateral pressure to the sides of the extender legs 143 such that they flex inward, thereby releasing the mating connection with the barb members 137 of the frame 114. The hanger extension flange 141 cantilevers from the base extender 142 in a direction opposite that of the extender legs 143. The hanger extension flange 141 can be attached to door frames, buildings, or the like so that the panel 110 hangs from the hanger conversion kit 140.

While the foregoing discussion is presented in terms of panels 10, 110 formed from an array of rectangular panes 12, 112, an ordinary practitioner will appreciate that the panels 10, 110 can be formed from a variety of shapes, sizes, and orientations of panes 12, 112, such as triangular, hexagonal, octagonal, and a variety of other shapes of panes 12, 112. The sizes and shapes of panes 12, 112 can be mixed and matched without departing from the scope of the customizable closure system disclosed herein.

Any of the foregoing embodiments can be implemented in connection with a reinforcing system for the panels 10. A reinforced panel 210 comprises vertical tendons 201 that are passed through or along the vertically disposed retaining members 213. The vertical tendons 201 are any long slender member configured for compressing the panel in an axial, or planar direction. For example, the vertical tendons 201 could be a cable, wire, threaded rod, metal rod, strap, or other such member.

Figure 20:
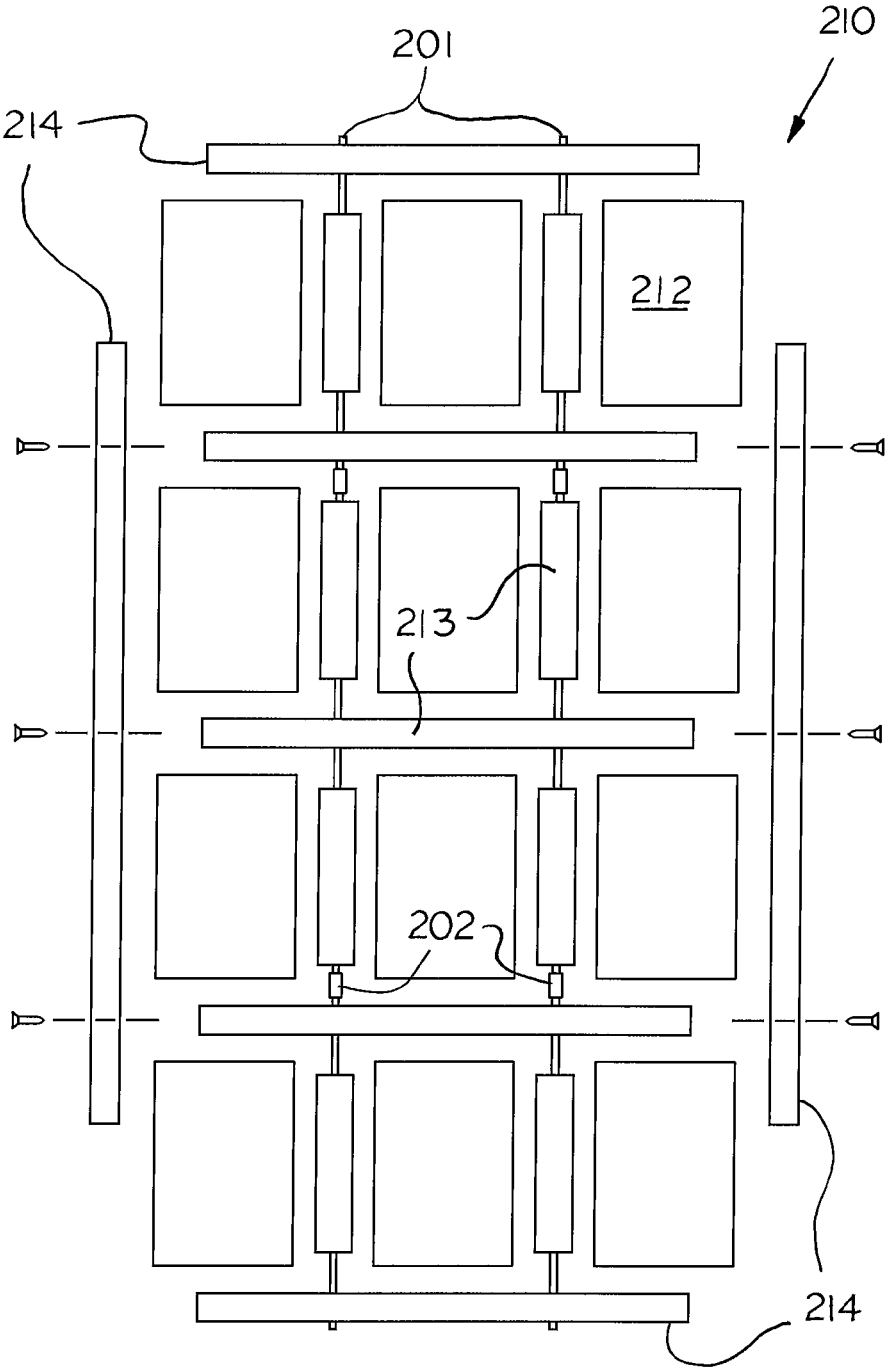
FIG. 20 shows an elevation view of an exploded panel having a reinforcing system for retaining the panes in a secure manner.

In one variation of this embodiment, as shown in FIG. 20, the vertical tendons 201 are disposed inside the vertical retaining members 213. The horizontal retaining members 213 comprise spaces, holes, or gaps for receiving the vertical tendons 201 passing the horizontal retaining members 213. The vertical tendons 201 are anchored in the frame 214, and pass through the vertically disposed retaining members 213 between the panes 212. In each tendon 201, one or more couplers 202 are used as desired to splice together two or more segments of tendons 201 in a substantially coaxial or colinear orientation. For example, when the tendons 201 comprise threaded rods, the couplers 202 comprise a threaded coupling nut for receivably mating with adjacent segments of the tendons 201 at opposite ends of the coupler 202.

After the vertical tendons 201 are passed through the vertical and horizontal retaining members 213, the opposite distal ends of the vertical tendons 201 are anchored into the frame 214 at the top and bottom, respectively, such as with a nut or coupler 202. The vertical tendons 201 are then tightened to compress the top and bottom horizontal members of the frame 214 together, thereby placing the panel 210 in compression along its vertical planar direction. This compression assists in retaining the panes 212 in a secure manner.

In the horizontal direction, the horizontal retaining members 213 span continuously from the outer edge of a pane 212 on one side of the panel 210 to the outer edge of a pane 212 on the opposite side of the panel 10.

The horizontal retaining member 213 is a member similar to that shown in FIG. 9 for the frame 114. The horizontal retaining member 213 has a web with a C-shaped recess. The vertical members of the frame 214 are fitted with screw holes that align with the C-shaped recess of the horizontal retaining member 213 in a manner similar to that shown in FIG. 7. Screws are inserted through the holes in the frame 114 and driven into the C-shaped recess, which acts like a socket to receive the screws. The C-shaped recess could be threaded with female threads, or it could comprise a soft metal that deforms under the force of the threads from the harder screw metal, as described above. Once the screws are tightened, the vertical frame 214 members are compressed against the panel 210, thereby placing the panel 210 in compression in the horizontal direction.

In another embodiment, the orientation of the horizontal retaining members 213 and the vertical retaining members 213 is reversed such that the vertical retaining members 213 span continuously along the vertical height of the panel 210, and the horizontal retaining members 213 are placed between the vertical retaining members 213. In this configuration, the tendons 201 span horizontally across the panel 10, and the vertical retaining members 213 function as the vertical tendons 201.

The foregoing embodiments are merely representative of the customizable closure system and not meant for limitation of the invention. For example, persons skilled in the art would appreciate that there are several embodiments and configurations of the panel members, and other components will not substantially alter the nature of the closure system. Likewise, elements and features of the disclosed embodiments could be substituted or interchanged with elements and features of other embodiments, as will be appreciated by an ordinary practitioner. Consequently, it is understood that equivalents and substitutions for certain elements and components set forth above are part of the invention described herein, and the true scope of the invention is set forth in the claims below.

The invention claimed is:

1. A customizable closure system comprising:

a first panel having an array of panes, the panes supported by at least one of one or more horizontal retaining members and one or more vertical retaining members, a mechanical fastener, and a frame defining an edge of the panel;

wherein the frame includes;

a web having a substantially H-shaped cross section comprising flanges forming a first channel recess for mating with a panel, a second channel recess for mating with an interface member, and an anchor member between the first channel recess and the second channel recess;

wherein the anchor member includes a panel abutting surface facing the first channel recess and two or more flanges of a C-shaped channel face and are contained within the second channel recess formed by two or more of the flanges from a first type of metal; and wherein the flanges include at least a first set of barbs within the first channel recess for increasing friction between the first channel recess and the first panel and thereby removably retain the first panel, and a second set of barbs within the second channel recess for increasing friction between the second channel recess and the interface member and thereby removably retain the interface member; and wherein the mechanical fastener includes a second type of metal being harder than the first type of metal to enable the mechanical fastener to be self-taping when positioned in the C-shaped channel of the anchor member, wherein the customizable closure system further comprises a swing kit comprising:

a swing interference member mated with a first side of the frame of the first panel, wherein a frame connection member of the swing interference member has a pair of extension legs disposed to form-fit inside the second channel recess of the web, and a C-shaped recess;

a hinge post having a first side and a second side, the first side of the hinge post having a hollow hinge rod sized to form-fit inside the C-shaped recess of the frame connection member of the swing interference member, and the second side of the hinge post having a pair of extension flanges for mating with a wall jamb member; and a closure interface member mated with a second side of the frame of the first panel, wherein a frame connection member of the closure interface member is a pair of extension legs disposed to form-fit inside the second channel recess of the web, and the frame connection member of the swing interface member is the wall jamb member.

2. The system of claim 1 further comprising a second panel being adjacent to the first panel; wherein the customizable closure system comprises a piano hinge extending along the first panel and the second panel.

3. The system of claim 1, additionally comprising:

a bypass kit comprising a header having a rail and a kit connection member, and the interface member comprises a hanger assembly;

wherein the kit connection member includes a pair of flanges configured for form-fit insertion into the second channel recess of the web, and the rail of the header is configured to receive at least one roller.

4. The customizable closure system of claim 1, wherein the first set of barbs are directed inwardly and toward the web, the system further comprising:

a hanger kit, said hanger kit comprising a hanger interface member, wherein a frame connection member of the hanger kit is a pair of extender legs, each extender leg having a barb configured to mate with and releasably connect to the second set of barbs within the second channel recess of the web.

5. The system of claim 4, additionally comprising:

a bypass kit comprising a header having a rail and a bypass kit connection member, and a hanger assembly, wherein;

the frame connection member of the hanger kit comprises a pair of flanges configured for form-fit insertion into the second channel recess of the web of the frame, and at least one roller configured to be seated on the rail of the header.

6. The system of claim 4, additionally comprising:

a jamb connection unit having a jamb connection member for detachably mating with a jamb contact member of the closure interface member.

7. The system of claim 1 further comprising a second panel;

wherein a room divider kit comprises a hinge member haying a first hinge plate that functions as a frame connection member, the first hinge plate configured to mate with the second channel recess of the frame of the first panel, and a second hinge plate that functions as a kit connection member, the second hinge plate configured to mate with a channel recess of the second panel.

8. The system of claim 1, additionally comprising a bypass kit having a header having a rail, and the interface member comprises a hanger assembly wherein a frame connection member of the hanger assembly is a pair of flanges configured for form-fit-insertion into the second channel recess of the frame of the panel, and a kit connection member comprises at least one roller configured to be seated on the rail of the header.

9. The system of claim 1, additionally comprising a jamb connection unit having a jamb connection member for detachably mating with a jamb contact member of the closure interface member.

10. The customizable closure system of claim 1, the customizable closure system further comprising:

a hanger kit, said hanger kit comprising a hanger interface member wherein a frame connection member of the hanger kit is a pair of extender legs, each extender leg having a barb configured to mate with and releasably connect to connection barbs in at least one of the flanges of the frame.

* * * * *